United States Patent [19]

Bartolles

[11] Patent Number: 4,709,616

[45] Date of Patent: Dec. 1, 1987

[54] OBTURATOR RING FOR A CANNON

[75] Inventor: Rolf Bartolles, Korschenbroich, Fed. Rep. of Germany

[73] Assignee: Rheinmetall GmbH, Duesseldorf, Fed. Rep. of Germany

[21] Appl. No.: 696,415

[22] Filed: Jan. 30, 1985

[30] Foreign Application Priority Data

Feb. 10, 1984 [DE] Fed. Rep. of Germany ..... 3404676

[51] Int. Cl.[4] ..... F41F 11/02

[52] U.S. Cl. ..... 89/26; 277/227; 277/235 R

[58] Field of Search ..... 89/26; 277/227, 235 R, 277/235 A, 236

[56] References Cited

U.S. PATENT DOCUMENTS

| | | | |
|---|---|---|---|
| 212,197 | 2/1879 | Crispin | 89/26 |
| 1,460,683 | 7/1923 | Schneider | 89/26 |
| 2,301,097 | 11/1942 | Tweedale | 277/235 |
| 3,403,596 | 10/1968 | Bartels | 89/26 |
| 3,567,258 | 3/1969 | Scaramucci | 277/236 |
| 3,707,900 | 1/1973 | Hornteck et al. | 89/26 |
| 4,566,368 | 1/1986 | Bartolles | 89/26 |

FOREIGN PATENT DOCUMENTS 1998040 5/1968 Fed. Rep. of Germany .

*Primary Examiner*—Frederick R. Schmidt
*Assistant Examiner*—Robert Showalter

[57] ABSTRACT

An obturator ring for location between a sliding wedge-type breech block and a base ring in the barrel of a cannon to provide a seal and allow satisfactory closing movement of the obturator ring. The ring comprises an angle section with a radial flank having a disc lining on the external side facing the breech, the flank which is parallel to the axis of the bore of the barrel having on the external side a cylindrical lining. The linings are deformable, incompressible and capable of being forced over their widths against the base ring or the wedge insert by the flanks which deform under gas pressure. The linings are interconnected in the corner cross section of the obturator ring via a number of connecting rod-like members disposed in bores through the obturator ring; the flanks are joined through a rounded corner portion which allows flexure to effect through the tips of the flanks. The linings provide a large sealing surface of which the minimum width is greater than one-half of the length.

4 Claims, 2 Drawing Figures

OBTURATOR RING FOR A CANNON

Figure 1:
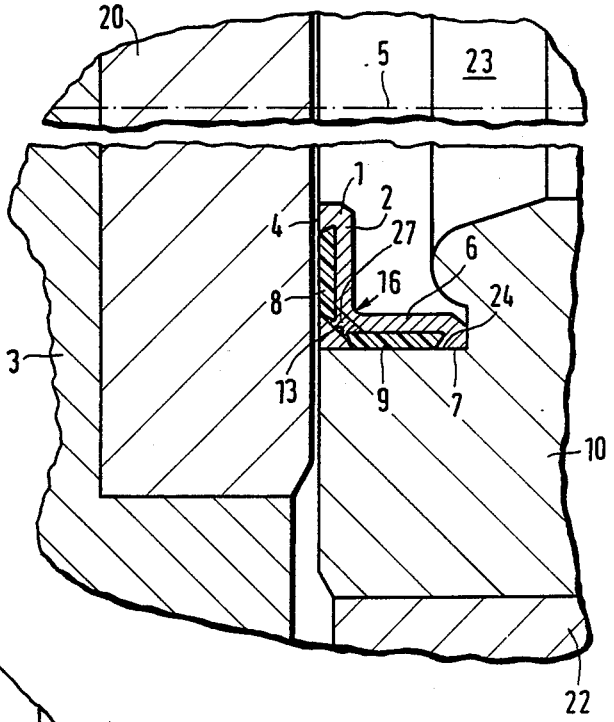

This invention relates to an obturator ring for a cannon.

An obturator is known from DE UM No. 19 98 040 wherein in the closed breech position of a tapered wedge-type breech block an obturator ring having an angle section bears by one flank against a wedge attachment fitted into the breech while the other flank is accommodated in a bore provided in the base ring, connected with the barrel of the weapon. In order to ensure a fully satisfactory sealing effect even in the event of very low gas pressures washers have to be used to vary the height at which the wedge attachment is fitted, so that it will be accurate enough to ensure that the adjacent flank of the obturator ring bears against the surface.

If foreign matter, such as particles of sand, powder residue or similar impurities are present, the operation of closing the breech may be made difficult and damage caused to the seals. In the event of such impurities, it is difficult to ensure that the obturator ring will bear fully against the wedge attachment, so that due to blow-back from charge gases, not only the attachment, but also the obturator ring itself, has to be removed and replaced earlier than usual.

An object of this invention is to provide an obturator ring whereby, even under favorable conditions of use, the wedge-type breech block can operate with a fully satisfactory closing movement, an immediate sealing effect being obtained even in the event of low gas pressures, and the service lift of the obturator ring of angular cross-section and positioned, in use, between the base ring of the barrel of the weapon and wedge insert forming a wedge-type breech block for the cannon wherein a radial flank of the obturator ring, which is positioned on an external side adjacent the breech block, houses a disc shape lining, and the flank parallel to the axis of the barrel, which is positioned on an external side, houses a cylindrical shape lining; the two linings being deformable, incompressible and capable of being forced over their entire width by the flanks, which are elastically deformable under gas pressure, against the base ring and the wedge, respectively.

This invention offers the advantage that comparatively resistant hard foreign matter, such particles of sand, can be accommodated by the elastically deformable lining so that gaps can be avoided between the wedge insert and the obturator ring by virtue of the external sides of the ring bearing fully against the surface in order to effect sealing.

Because the flanks of the obturator ring each has a trapezoidal shape recess, to accommodate the lining with the external side of the said recess decreasing at a linear rate in an outward direction, the lining is able to bear firmly in position, thus providing a good sealing effect between the obturator ring and the lining during the sealing process. The positioning of the linings are also made firmer by the fact that they are interconnected, within the corner cross section, through a number of connection apertures.

An additional advantage is that through the bore and by the transition of the insides of the flanks being backed-off or relieved, a comparatively resilient corner cross section for the obturating movement of the two flanks is obtained. The backing-off of the flanks offers a further decisive advantage in that besides the preliminary obturation provided by the obturator cross sections formed by the tops of the flanks, the linings, at least over a comparatively large width, which is equal to at least half the length of the inside face, are forced against the wedge insert or base ring by the elastically deformable flank cross sections. The linings are thus able, even while gas pressures are still comparatively low, to bridge and seal the breech clearance required for the closing movement, and to provide a reliable seal. The flanks can resume their original shape elastically after the sealing has been effected.

Yet a further advantage is the fact that because of the largely impact-proof elastically deformable linings and their ability to absorb foreign bodies, a considerable sealing effect and a greatly increased service life for the ring obturator is obtained.

The invention is explained in more detail by reference to an embodiment shown as example in the drawings.

Details not essential to the invention have been largely omitted.

Figure 2:
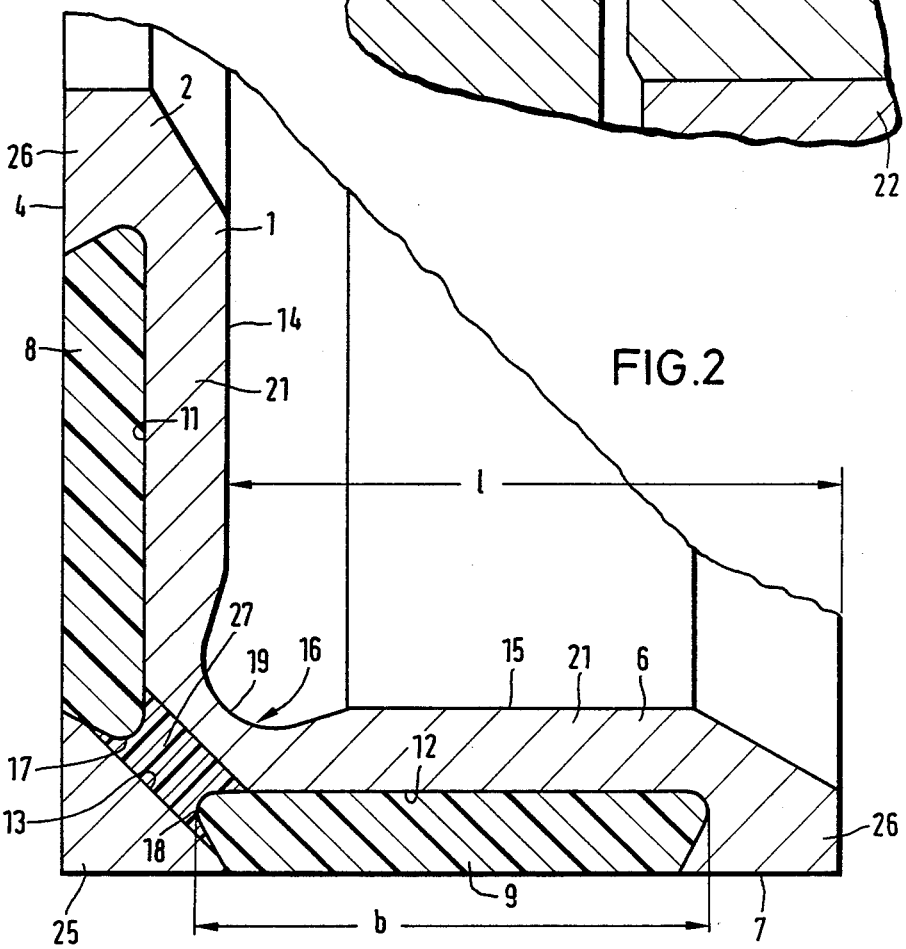

In the drawings:

FIG. 1 shows a cross section of part of an obturator ring positioned between the base ring of the barrel of a cannon and a wedge insert forming a wedge-type breech block, and FIG. 2 shows a part cross section on an enlarged scale through the obturator ring.

As shown in FIG. 1, an obturator ring 1 is provided between a base ring 10 of the barrel 22 of a cannon (not shown) and a tapered or wedge insert 20 of the wedge-type breech block 3. The breech 3 together with the insert 20 is arranged to be displacable transverse to the axis 5 of the barrel. A very small clearance is provided to accommodate the breech position of the loading chamber 23 between the obturator ring 1 and the wedge insert 20.

The obturator ring 1 is provided, on a radially positioned cross sectional flank 2, on the external side 4 facing the breech 3, with a disc shaped lining 8, while the cross sectional flank 6 situated parallel to the axis 5 of the barrel is provided, on the external side 7, with a lining 9, of cylindrical section, linings 8 and 9 being integrally connected as explained below. The said linings are deformable, and incompressible over width b. Thus the lining is capable of being forced against the wedge insert 20 by the flank 2, which is elastically deformable under gas pressure, and forced against a bore 24 in the base ring 10 by flank 6.

FIG. 2 show the arrangement of the linings 8 and 9 of the obturator ring in more detail. The cross sectional flanks 2 and 6 of the obturator ring 1 are provided with trapezoidal section recesses 11 and 12 serving to accommodate the linings 8 and 9 respectively. The cross sectional width b decreases linearly towards the external sides 4, 7. The linings 8 and 9 are situated in the recesses 11 and 12, respectively; as above noted, they are interconnected.

Such interconnection takes the form of a plurality of angularly distributed rod-like members 27, disposed within apertures 13 extending diagonally inside the corner cross section 25 of the obturator ring 1. The connecting apertures 13 leading into the mutually facing corners 17, 18 of the recesses 11 and 12. The linings 8 and 9 and the connecting members 27 may be integrally molded in situs.

On the inside the transition 16 (FIG. 1), of the internal sides 14 and 15 of the cross sectional flanks 2 and 6; is backed-off or relieved to form a bending zone and the transition can be formed as a rounded part 19 or as a curve (not shown) so that the minimum width b of the recess 11 and 12 is equal to half the length 1 of the internal side 14, 15 of the flank, while a comparatively wide lining 8 and 9 of the recess 11 and 12, from the transition 16, is positioned opposite the internal side 14 and 15 and extending generally parallel.

The obturator ring 1 is made of metal, preferably steel, and has through the connecting apertures 13, and as a result of the backing-off of the transition 16, an elastic corner cross-section 25 so that the two flanks 2, 6 may move. The linings are preferably made of elastically deformable sealing materials, such as an elastomer.

Over a comparatively large width b, the flank cross sections 21, formed by the recesses 11 and 12, bear in each case against the surfaces of the flank tips 26, and the bearing surfaces of the corner cross section 25 with an initial obturating effect, so that good elastic deformability of the flank sections 21 and immediate reduction in the size of the recesses 11 and 12 are obtained at low pressures and small loads. This is in addition to the reliable sealing of the gap between the wedge insert 20 and the base ring 10 by the linings 8 and 9.

The insert composed of the linings 8 and 9 and the interconnecting rod-like parts 27, as above noted, is composed of an elastomer. From a large selection of elastomers perbunane (a Buna variety, International designation NBR) or silicone rubber are preferably used.

Although the invention is described and illustrated with reference to a plurality of embodiment thereof, it is to be expressly understood that it is in no way limited to the disclosure of such preferred embodiment but is capable of numerous modifications within the scope of the appended claims.

I claim:

1. A ring breech obturator system for a cannon, comprising an obturator ring having an angular cross section, which is positioned in use between the base ring of the barrel of the cannon and a wedge insert of a wedge-type breech block of the cannon, wherein a radial flank of the obturator ring, having internal and external sides, has positioned, on its external side adjacent the wedge insert of the breech block, a disc-shaped lining, and wherein a flank parallel to the axis of the barrel, having internal and external sides, has positioned, on its external side, a cylindrical-shaped lining, the two linings being deformable under gas pressure against the base ring and the wedge insert, respectively; the flanks of the obturator ring each has a trapezoid cross sectional recess to accommodate the respective linings, the cross section of each recess decreasing in width linearly towards the outer surface; said disc-shaped lining and said cylindrical-shaped lining, are each composed of an elastomer.

2. A ring breech obturator in accordance with claim 1, wherein the linings are interconnected by a number of connecting rod-like members disposed in apertures provided with in a corner junction between the flanks, the apertures connecting mutually facing side of the recesses.

3. A ring breech obturator in accordance with claim 1, wherein a transition at the corner junction of the internal sides of the flanks of the obturator ring is backed off, rounded or relieved.

4. A ring breech obturator in accordance with claim 3, wherein the minimum width of each recess is equal to half the length of the respective internal side of a flank, the recesses commencing from the transition and being positioned opposite and generally parallel at the internal sides of the flanks of the obturator ring.

* * * * *